US011014695B2

(12) United States Patent
Hansen et al.

(10) Patent No.: US 11,014,695 B2
(45) Date of Patent: May 25, 2021

(54) HIGH-SPEED CONTAINER FILLING WITH REDUCED CROSS-CONTAMINATION

(71) Applicant: ARxIUM, Inc., Buffalo Grove, IL (US)

(72) Inventors: Niels Erik Hansen, Burlington (CA); Thomas Doherty, Winnipeg (CA)

(73) Assignee: ARxIUM, Inc., Buffalo Grove, IL (US)

( * ) Notice: Subject to any disclaimer, the term of this patent is extended or adjusted under 35 U.S.C. 154(b) by 147 days.

(21) Appl. No.: 16/181,859

(22) Filed: Nov. 6, 2018

(65) Prior Publication Data

US 2020/0140123 A1 May 7, 2020

(51) Int. Cl.

| | |
|---|---|
| ***B65B 1/10*** | (2006.01) |
| ***B65B 55/24*** | (2006.01) |
| ***B65B 37/08*** | (2006.01) |
| ***A61J 7/00*** | (2006.01) |
| ***B65B 43/60*** | (2006.01) |
| ***B65B 55/02*** | (2006.01) |

(52) U.S. Cl.

CPC ..... *B65B 1/10* (2013.01); *A61J 7/0076* (2013.01); *B65B 37/08* (2013.01); *B65B 43/60* (2013.01); *B65B 55/027* (2013.01); *B65B 55/24* (2013.01)

(58) Field of Classification Search

CPC .... B65B 1/06; B65B 1/10; B65B 1/28; B65B 5/103; B65B 37/00; B65B 37/08; B65B 39/00; B65B 39/007; B65B 55/24; B65B 65/006; B65B 2039/009; B65B 2210/02; B65B 43/60; A61J 7/0076; A61J 7/0084

USPC ..... 53/202, 253; 221/119, 123, 124, 130, 221/132

See application file for complete search history.

(56) References Cited

U.S. PATENT DOCUMENTS

| | | | | | |
|---|---|---|---|---|---|
| 2,801,025 | A | * | 7/1957 | Cookson et al. | B65B 5/103 221/203 |
| 3,018,595 | A | * | 1/1962 | Harris et al. | B65B 5/103 53/501 |
| 3,028,713 | A | * | 4/1962 | Kennedy et al. | B65B 5/103 53/251 |
| 3,045,720 | A | * | 7/1962 | Jungmayr et al. | B65B 39/14 141/145 |
| 3,055,403 | A | * | 9/1962 | Barresi | B65B 1/28 141/93 |
| 3,061,990 | A | * | 11/1962 | Lakso | B65B 5/103 53/237 |
| 3,064,406 | A | * | 11/1962 | Kennedy et al. | B65B 5/103 53/240 |
| 3,139,713 | A | * | 7/1964 | Merrill et al. | B65B 5/103 53/55 |
| 3,206,062 | A | * | 9/1965 | Rappaport | B65B 5/103 221/7 |

(Continued)

FOREIGN PATENT DOCUMENTS

| | | | | | |
|---|---|---|---|---|---|
| DE | 4118547 | A1 | * | 12/1992 | B65B 43/60 |
| FR | 1558658 | A | * | 2/1969 | B65B 1/06 |
| GB | 869321 | A | * | 5/1961 | B65B 1/06 |

*Primary Examiner* — Stephen F. Gerrity

(74) *Attorney, Agent, or Firm* — Reinhart Boerner Van Deuren s.c

(57) ABSTRACT

A medical dispensing system with dispensing and pathway components, each of which includes a plurality of dispensers and pathways, respectively. The dispensing and pathway components are controlled to minimize contamination between the items being dispensed. Both the dispensing and pathway components have arcs around which the dispensers and pathways are arranged.

17 Claims, 10 Drawing Sheets

(56) References Cited

U.S. PATENT DOCUMENTS

| | | | | | |
|---|---|---|---|---|---|
| 3,354,607 | A * | 11/1967 | Lakso | B65B 5/103 | 53/167 |
| 3,706,395 | A * | 12/1972 | Havener et al. | A47F 1/10 | 221/119 |
| 4,150,766 | A * | 4/1979 | Westendorf et al. | B65D 83/0409 | 221/112 |
| 5,687,551 | A * | 11/1997 | Mustain et al. | B65B 43/60 | 53/570 |
| 5,752,368 | A * | 5/1998 | Tobe | B65B 5/103 | 221/3 |
| 5,791,127 | A * | 8/1998 | Rossi | B65B 1/363 | 53/559 |
| 6,119,440 | A * | 9/2000 | Benner, Jr. | B65B 39/145 | 53/202 |
| 6,705,487 | B2 * | 3/2004 | Kim | B65B 35/56 | 141/247 |
| 8,464,899 | B2 * | 6/2013 | Clarke et al. | B65B 39/007 | 221/133 |
| 8,584,713 | B2 * | 11/2013 | Kawanishi | B65B 39/145 | 141/145 |
| 2004/0261357 | A1 * | 12/2004 | Takahashi et al. | B65B 5/103 | 53/247 |
| 2011/0146843 | A1 * | 6/2011 | Ansaloni et al. | B65B 5/103 | 141/369 |
| 2019/0127091 | A1 * | 5/2019 | De Boer et al. | B65B 5/103 | |

* cited by examiner

HIGH-SPEED CONTAINER FILLING WITH REDUCED CROSS-CONTAMINATION

FIELD OF THE INVENTION

This disclosure relates generally to dispensers of medical supplies. This disclosure relates more specifically to a dispenser of medical supplies, such as pills, that provides for a reduced risk of cross-contamination of the medical supplies being dispensed.

BACKGROUND OF THE INVENTION

Existing automated systems for dispensing medical supplies, such as pills or capsules, are often used to expedite the filling of containers, such as bottles with pills. A problem with many of these systems is a risk of cross-contamination of the different medical supplies. For example, when the automated system dispenses a first drug A, a powder residue from the first drug A may adhere to certain components in the dispensing system. Subsequently when a second drug B is dispensed, part of the powder residue from drug A may adhere to drug B, and as a result the patient taking drug B will unknowingly also be taking trace amounts of drug A. Often the amount of cross-contamination is so minimal as to be inconsequential, but for some drugs and for some patients any cross-contamination should be avoided.

The disclosure describes one or more embodiments of medical supply dispensing systems. These and other advantages of the disclosure, as well as additional inventive features, will be apparent from the description of the invention provided herein.

BRIEF SUMMARY OF THE INVENTION

In one aspect, the disclosure provides a medical dispensing system. The medical dispensing system includes dispensing and pathway components. The dispensing component includes several dispensers for medications. The pathway component includes a corresponding number of pathways to facilitate the dispensers placing medication in a container. Both the dispensing and pathway components are circular and the dispensers and pathways are arranged around the periphery of the respective components.

The circular dispensing and pathway components are arranged above and on either side of a conveyer for medication containers. The conveyer for medication containers receives empty containers and moves them to a filling area. The dispensing and pathway components overlap above the conveyer, in the filling area, from opposite sides of the conveyer.

In another aspect, the filling area is hermetically sealed from an external environment. The sealed area encompasses the filling area and most of the dispensing and pathway components, which are collectively referred to as the contaminated area. Individual dispensers and pathways rotate into and out of the contaminated area as the dispensing and pathway components are rotated. The contaminated area is maintained with a slight negative air pressure relative to the external environment, thus reducing the likelihood of contaminants leaving the contaminated area.

In yet another aspect, multiple conveyers, dispensing and pathway components are vertically arranged with respect to each other. Such an arrangement reduces the volume needed for multiple embodiments of this disclosure, thus providing a space-efficient structure.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
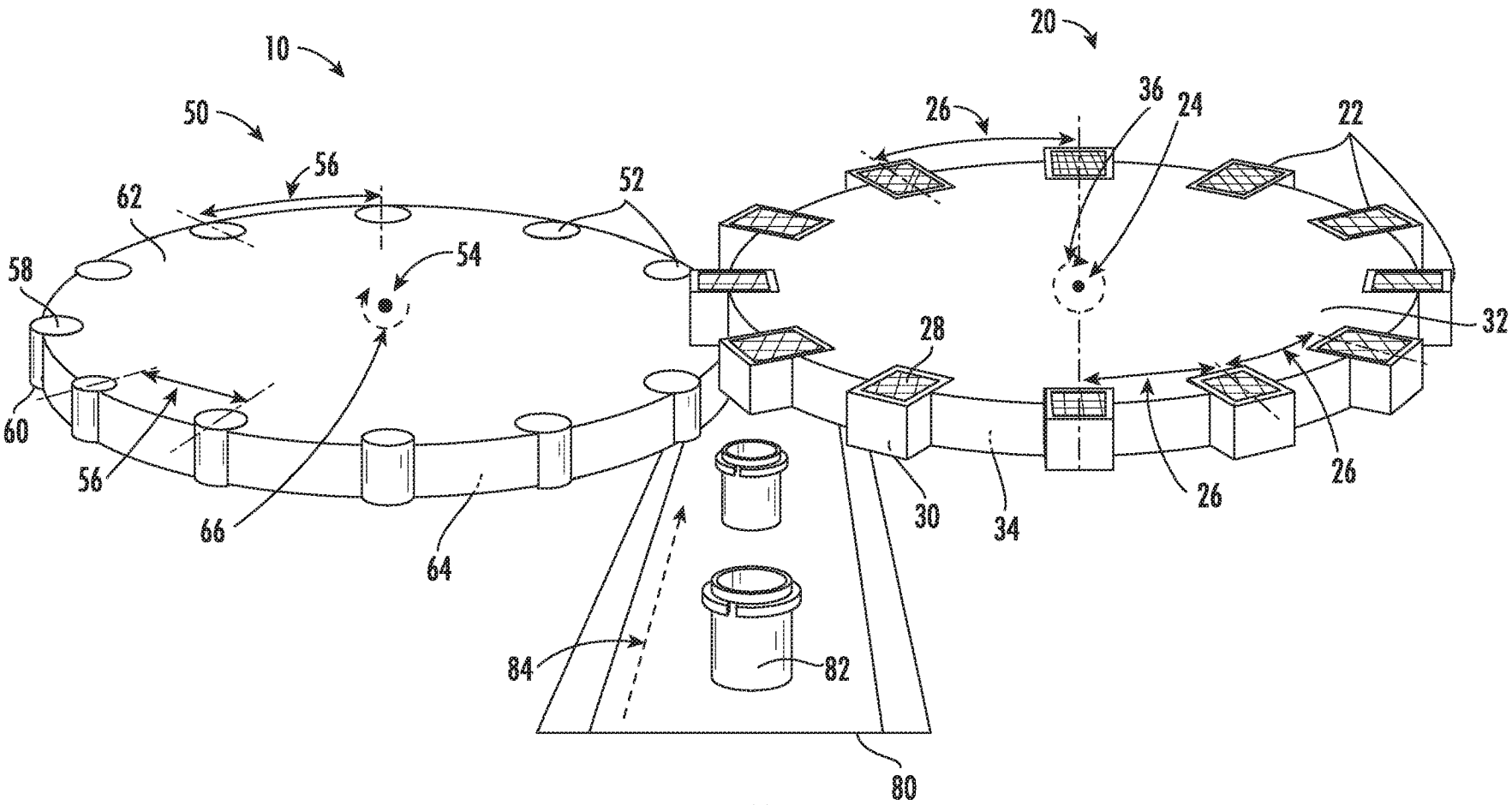
FIG. 1 is a perspective view of a medical dispensing system according to an embodiment.

While the disclosure will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Automated medication dispensers are being increasingly used by pharmacists to improve their responsiveness to receiving orders for medication. An important issue when dispensing medication, via manual or automated means, is to minimize contamination to or from the medication being dispensed. The medications that are placed into these containers may be classified as hazardous. Dust and other particulates from the dispensing system may become airborne. This can be a risk to people around medication dispensing systems.

Additionally there is also a risk of dust or other particulate entering the dispensed containers either through airborne particulates, particulates from conveyors or other equipment, or tablets (partial or whole) that may have been left from other operations. These cross-contaminating particulates may remain in shared pathways or common funnels or chutes. These types of particulates can represent a risk to end users and recipients of the medication containers.

It is the intent of this disclosure to provide a design that can achieve high speed high volume container filling, while eliminating or reducing exposure and risk to both operators and those receiving the dispensed/filled containers.

Referring to FIGS. 1-4, a dispensing system according to an embodiment is shown. Dispensing system 10 comprises dispensing disc 20 and pathway disc 50 selectively interacting to dispense medications into containers 82 on conveyer 80. Dispensing disc 20 is positioned slightly above pathway disc 50. Pathway disc 50 is positioned slightly below dispensing disc 20 to facilitate medication being placed into containers 82.

Dispensing disc 20 comprises multiple dispensers 22 arranged around periphery 40 of dispensing disc 20. Arc distance 26 separates dispensers 22. In use, dispensing disc 20 may rotate around center 24 in either clockwise direction 36 or the reverse rotational direction.

Similarly, pathway disc 50 comprises multiple pathways 52 around periphery 70 of pathway disc 50. Arc distance 56 separates pathways 52. In use, pathway disc 50 may rotate around center 54 in either clockwise direction 66 or the reverse rotational direction.

As medication is dispensed, particulates from the medication (e.g., airborne particles, dust) may be created. Controlling the distribution of the contaminating particulates is a goal of this disclosure. A specific pathway 52 is restricted to interact with (e.g., dispense medication for) dispensers 22 carrying a given medication (e.g., medication X). In a particular use, each dispenser 22 carries a different medication, and as a result each pathway 52 only interacts with a single dispenser. However, it is contemplated that for popular medications multiple dispensers 22 may include the same medication, thus allowing a single pathway 52 to interact with multiple dispensers 22.

Figure 2:
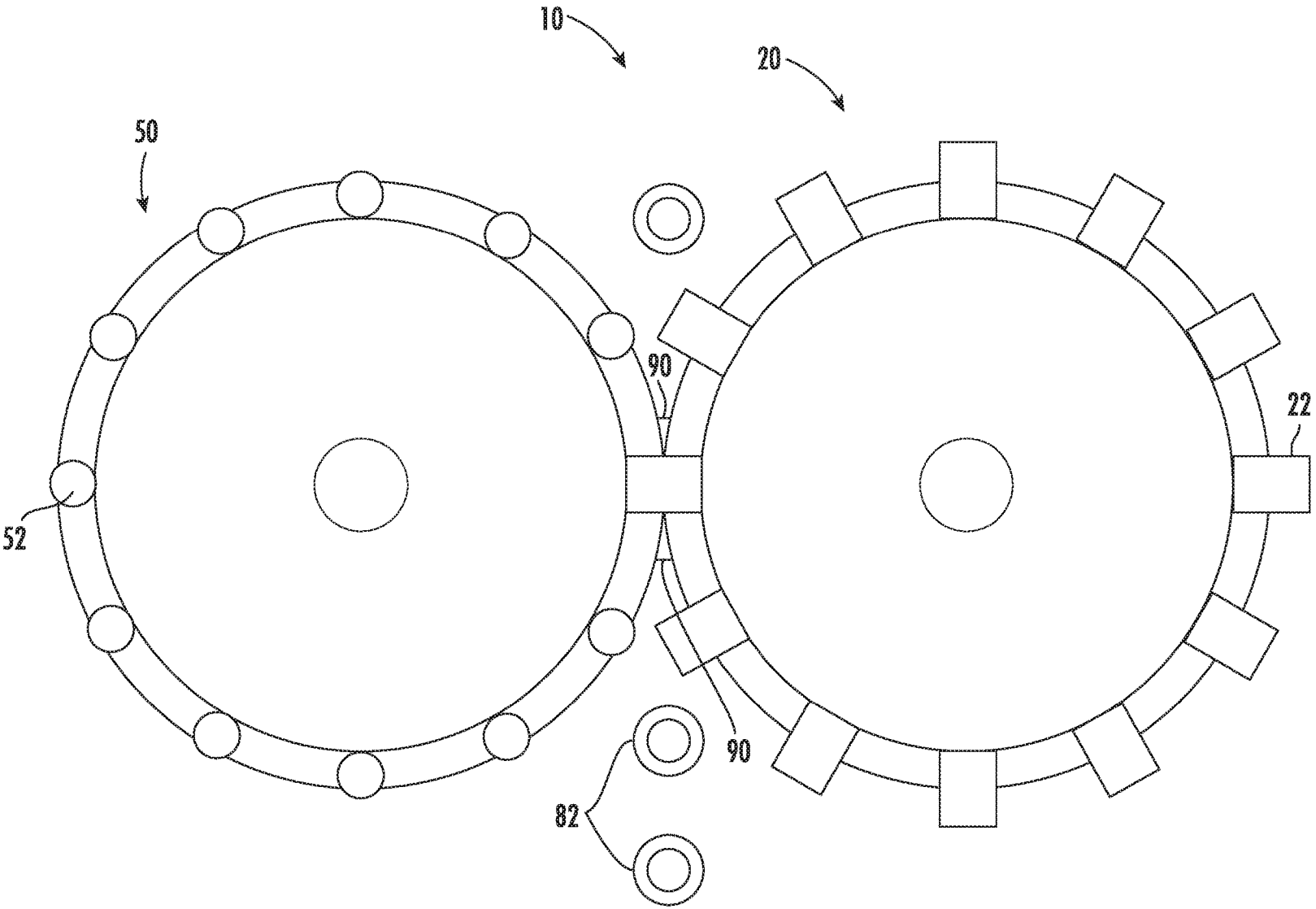
FIG. 2 is a schematic top view of the embodiment of FIG. 1.

Turning to FIG. 2, dispensing disc 20 and pathway disc 50 rotate such that only a single dispenser 22 and pathway 52, respectively, may be located within filling area 90 at a time. In use, when a specific dispenser 22 and a specific pathway 52 are aligned within filling area 90, and container 82 is positioned to receive medication, dispenser 22 dispenses medication into container 82 via pathway 52. In one or more embodiments, a given dispenser 22 only dispenses medication when an associated pathway 52 is beneath given dispenser to facilitate the medication being placed into container 82.

Figure 3:
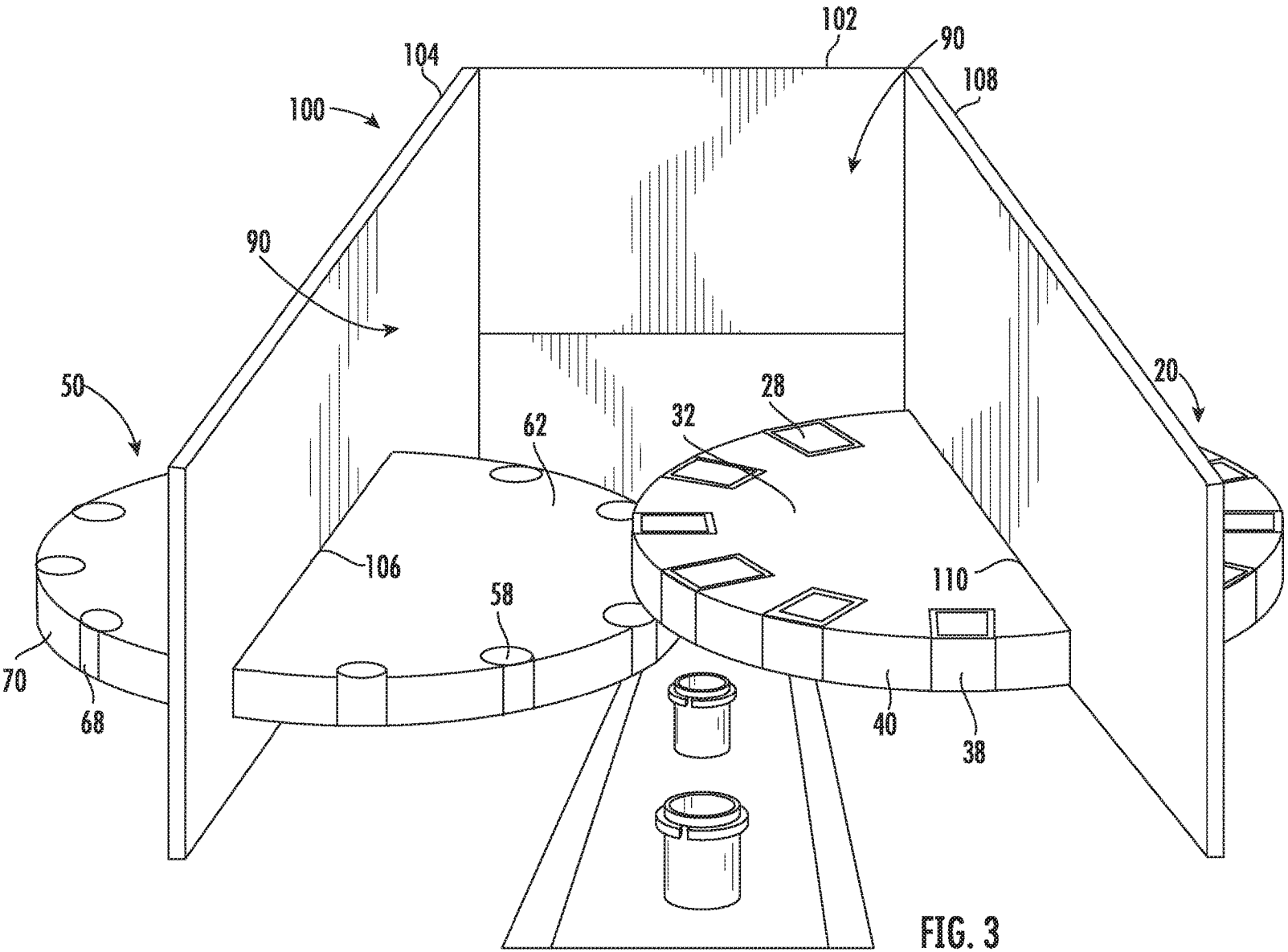
FIG. 3 is a partial perspective view of a medical dispensing system according to another embodiment.

Turning to FIG. 3, to further reduce the likelihood of contamination of particulate medication, dispensing system 10 may further comprise containment structure 100. Containment structure 100 restricts and at least partially prevents medication particulates from being allowed to contaminate personnel. Containment structure 100 includes back wall 102 and side walls 104 and 108. Pathway disc 50 transits left side wall 104 via aperture 106, and dispensing disc 20 transits right side wall 108 via aperture 110. Front wall, top wall, and bottom wall of containment structure 100 are not shown. Collectively the walls of containment structure 100 generally restrict medication particulates to remaining filling area 90.

Figure 4:
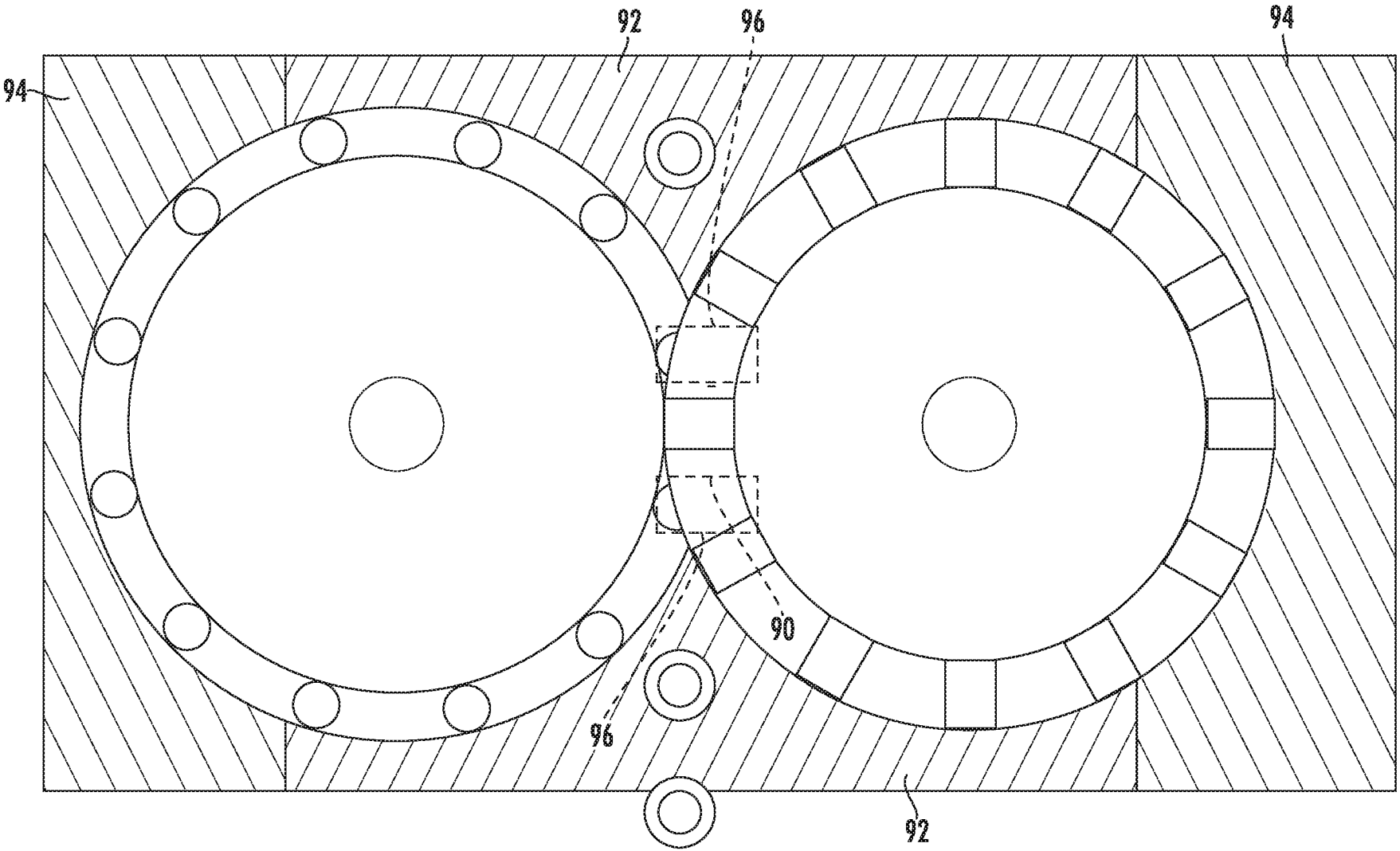
FIG. 4 is a schematic top view according to the embodiment of FIG. 3.

Turning to FIG. 4, contaminated area 92 is enclosed by containment structure 100, and cleaning area 94 is external to contaminated area 92. In one or more embodiments, contaminated area 92 has a reduced air pressure relative to cleaning area 94. As a result of the difference in air pressure, any leaks between contaminated area 92 and cleaning area 94 result in flow into contaminated area 92 rather than out of it. To maintain the negative relative air pressure in contaminated area 92, a pump or blower and associated duct work and air filters (not shown) removes air from contaminated area 92 while simultaneously filtering the removed air.

In use, pathway disc 50 and dispensing disc 20, including pathways 52 and dispensers 22, are cleaned in cleaning area 94. Additionally, dispensers 22 are filled and refilled in cleaning area 94.

Top surface 62 of pathway disc 50 is generally co-planar with top surface 58 of pathways 52, and bottom surface 64 of pathway disc 50 is generally co-planar with bottom surface 60 of pathways 52. Outer periphery 68 of pathways 52 is arcuately co-planar with periphery 70 of pathway disc 50 (best shown in FIG. 3). As a result, while pathway disc 50 rotates through aperture 106, the seal between contaminated area 92 and cleaning area 94 is not compromised by the rotation of pathway disc 50.

Similarly, top surface 32 of dispensing disc 20 is generally co-planar with top surface 28 of dispensers 22, and bottom surface 34 of dispensing disc 20 is generally co-planar with bottom surface 30 of dispensers 22. Outer periphery 38 of dispensing disc 20 is arcuately co-planar with periphery 40 of dispensing disc 20 (best shown in FIG. 3). As a result, while dispensing disc 20 rotates through aperture 110, the seal between contaminated area 92 and cleaning area 94 is not compromised by the rotation of dispenser disc 20.

Figure 5A:
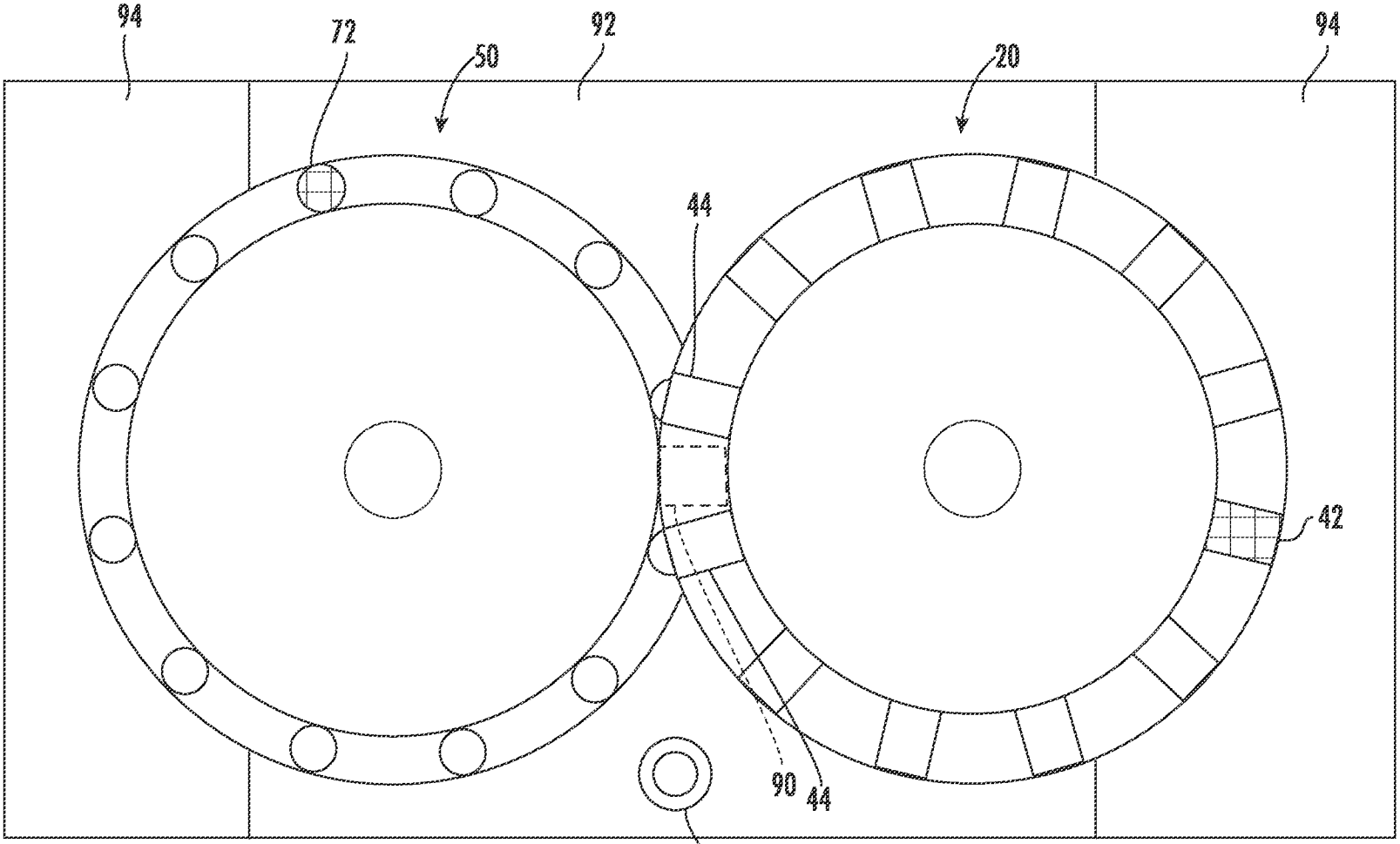
FIG. 5A is a top schematic view of a medical dispensing system according to another embodiment, shown in a first position.

Turning to FIGS. 5A-5E, illustrated therein is an exemplary series of steps to use this disclosure. At FIG. 5A, dispensing system 10 receives a request to dispense a medication (e.g., Medication A). For illustrative purposes, target dispenser 42 carries Medication A and target pathway 72 works in conjunction with target dispenser 42 to distribute Medication A into the appropriate container 82. As can be seen in FIG. 5A, both target dispenser 42 and target pathway 72 are not within filling area 90. In one or more embodiments, target dispenser 42 is configured to distribute Medication A as a result of (a) target dispenser 42 being rotated to within filling area 90, (b) target pathway 72 being aligned with, and optionally coupled to, target dispenser 42 within filling area 90, and (c) container 82 being in position within filling area 90 to receive Medication A.

Figure 5B:
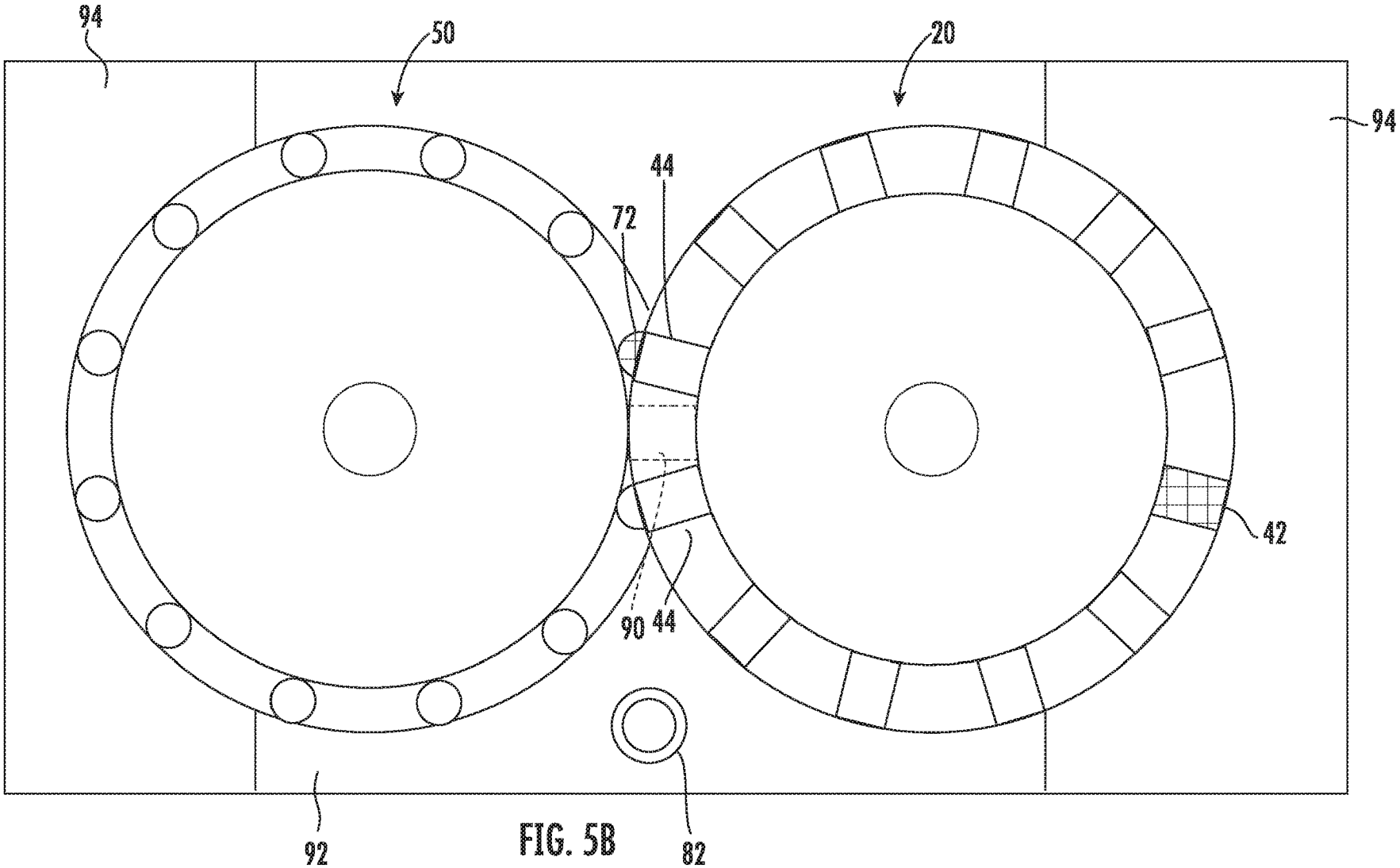
FIG. 5B is a top schematic view according the embodiment of FIG. 5A, shown in a second position.
Figure 5C:
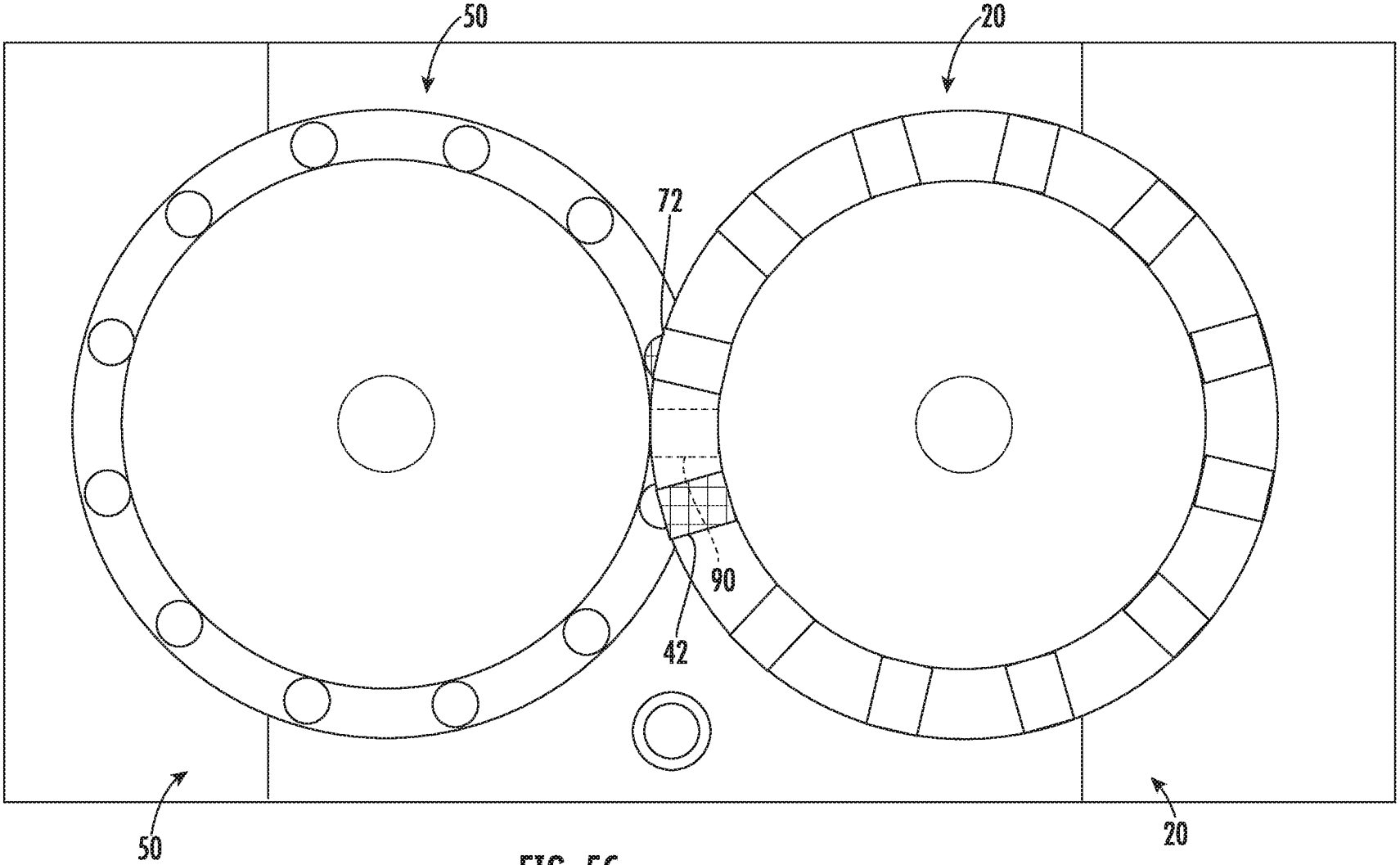
FIG. 5C is a top schematic view according the embodiment of FIG. 5A, shown in a third position.
Figure 5D:
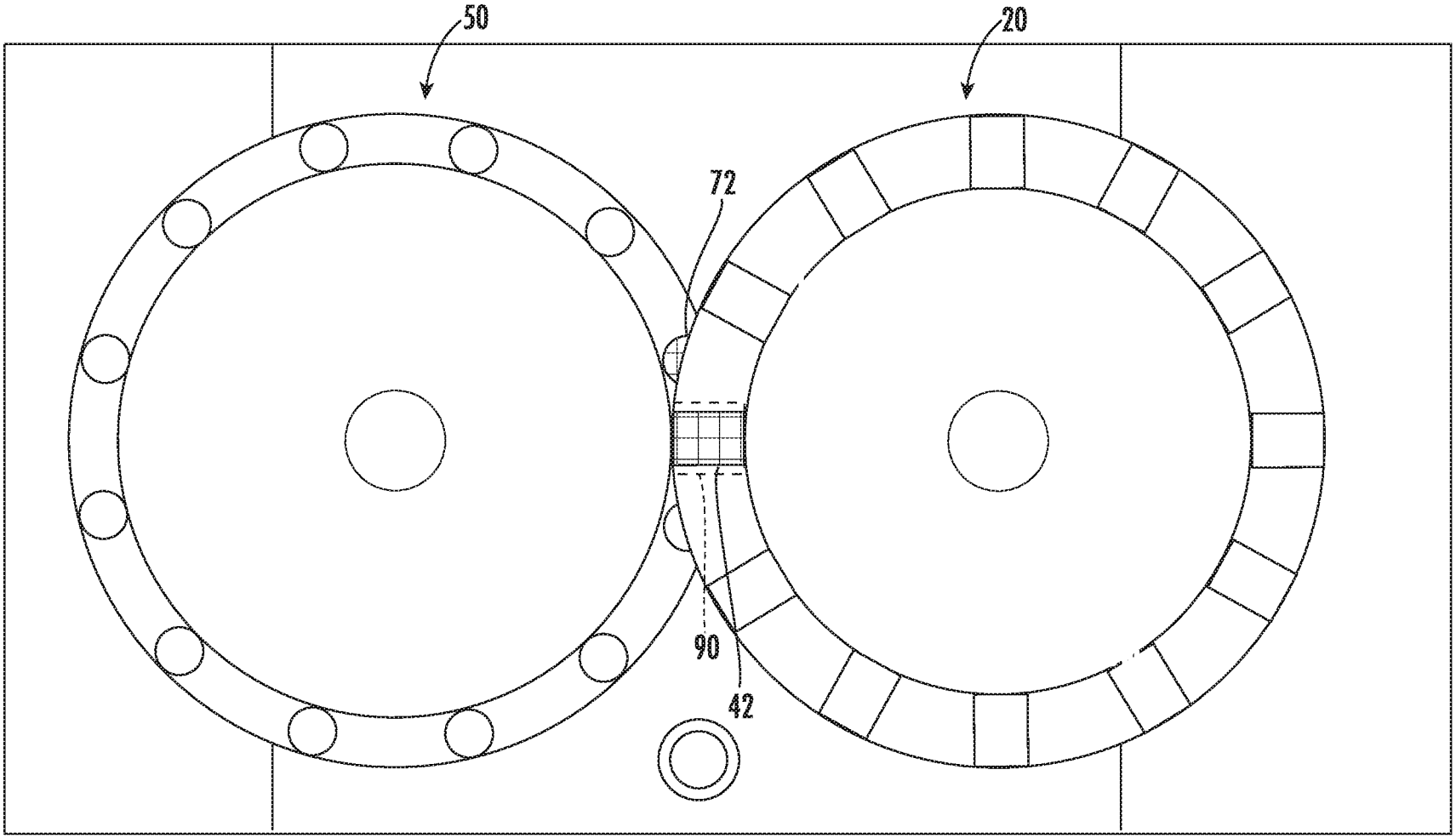
FIG. 5D is a top schematic view according the embodiment of FIG. 5A, shown in a fourth position.
Figure 5E:
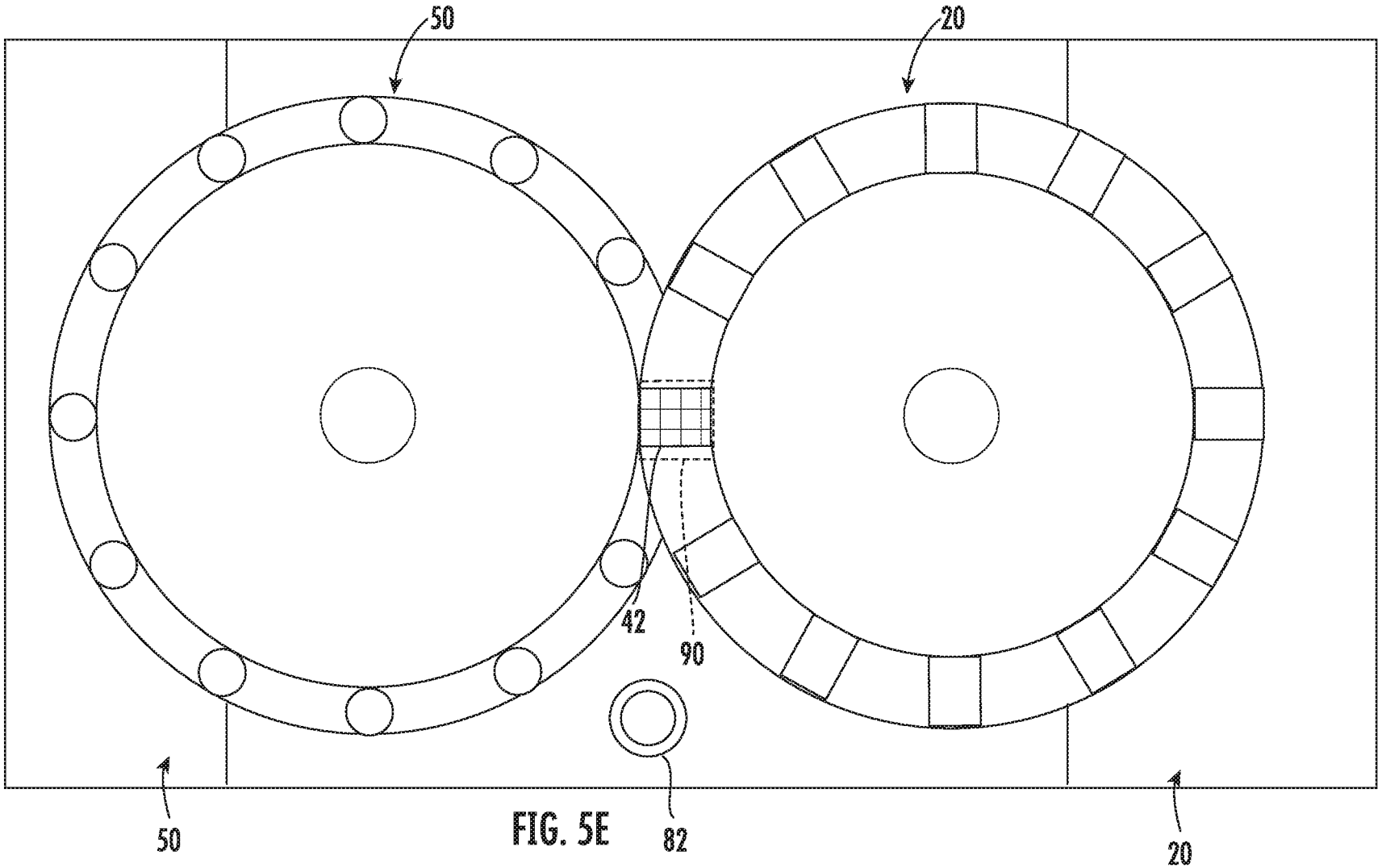
FIG. 5E is a top schematic view according the embodiment of FIG. 5A, shown in a fifth position.

Referring to FIG. 5B, subsequently pathway disc 50 is rotated to relocate target pathway 72 to a holding area 96 (best shown in FIG. 4) that is proximate and external to filling area 90. It will be noted that target dispensers 42 is still located relatively further away from filling area 90, and non-target dispensers 44 are in holding area 96. Referring to FIG. 5C, subsequently dispenser disc 20 is rotated to relocate target dispenser 42 to a holding position that is proximate and external to filling area 90. Subsequently dispenser disc 20 is rotated to relocate target dispenser 42 to filling area 90 (best shown in FIG. 5D), and subsequent to that pathway disc 50 is rotated to relocate target pathway 72 to filling area 90 beneath and aligned with target dispenser 42 (best shown in FIG. 5E). Once target dispenser 42, target pathway 72 and container 82 (not shown) are in filling area 90, Medication A is distributed to container 82 from target dispenser 42 via target pathway 72. Although this exemplary process details a specific order of steps, it is contemplated herein that the steps may be practiced in any order that would be practicable.

Figure 6:
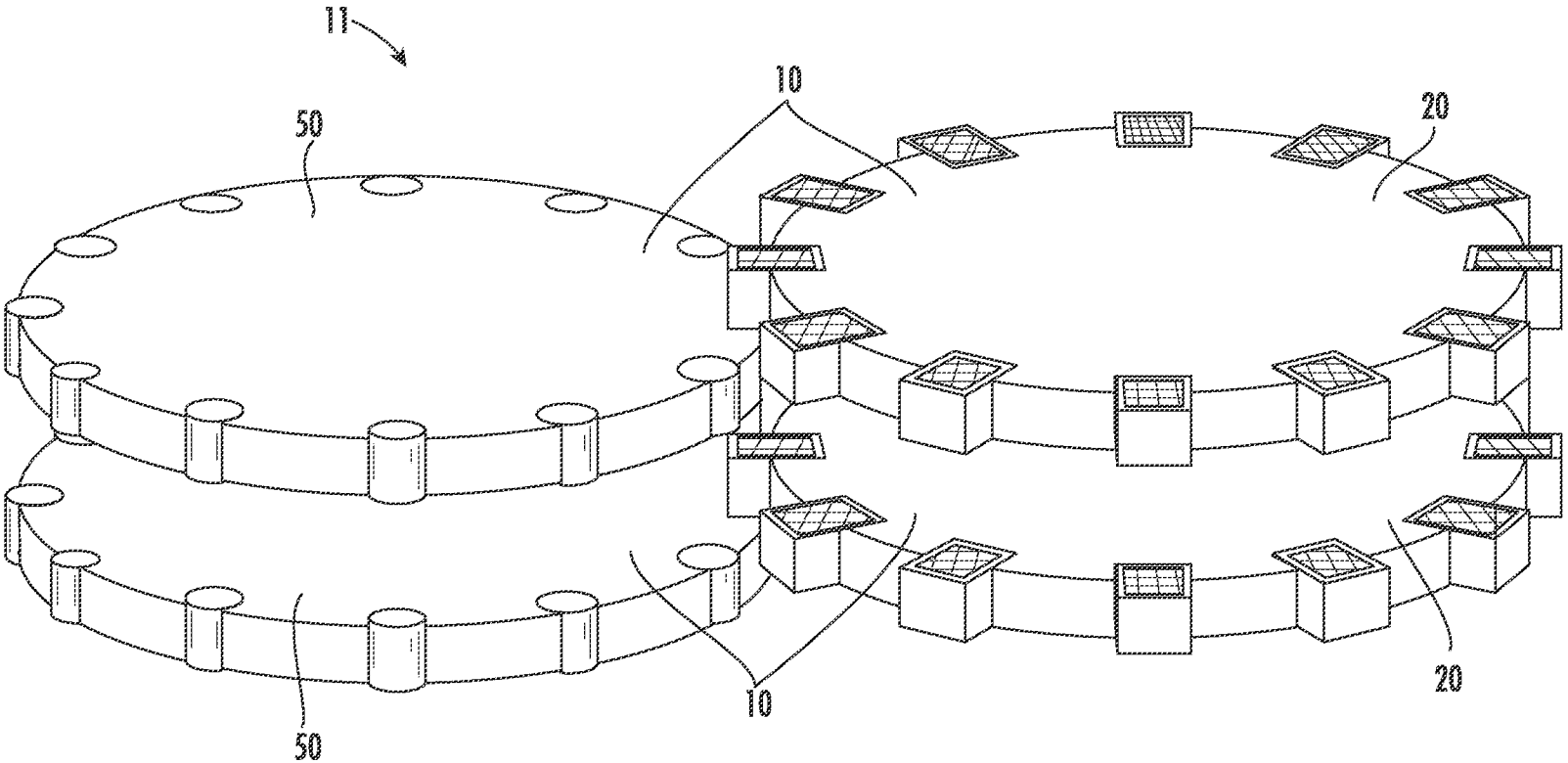
FIG. 6 is a perspective view of a medical dispensing system according to an embodiment.

Referring to FIG. 6, illustrated therein is an exemplary embodiment of multiple dispensing systems 10 that are arranged vertically with respect to each other. By this arrangement, efficiencies of space may be realized. For example, side walls 104 and 106 of contaminated area 92 may be shared between different dispensing systems 10.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A medical dispensing system comprising:

a filling area where a plurality of medications are dispensed into containers;

a pathway component comprising a plurality of pathways that include a first pathway, the first pathway being restricted to only dispense a first medication of the plurality of medications;

a dispensing component comprising a plurality of dispensers that include a first dispenser containing the first medication, the dispensing component being rotatable to selectively position the first dispenser in the filling area, the first dispenser dispensing the first medication as a result of both the first dispenser and the first pathway being located in the filling area;

a containment structure;

a contamination area interior to the containment structure, the contamination area including the filling area and a portion of each of the pathway component and the dispensing component; and an external cleaning area, the cleaning area being hermetically sealed from the contamination area.

2. The medical dispenser of claim 1, wherein the dispensing component is circular and the plurality of dispensers are disposed along the periphery of the dispensing component.

3. The medical dispenser of claim 2, wherein the pathway component is circular and the plurality of pathways are disposed along the periphery of the pathway component.

4. The medical dispenser of claim 1, the pathway component comprising a pathway holding position outside the filling area.

5. The medical dispenser of claim 1, the dispensing component comprising a dispenser holding position outside the filling area.

6. The medical dispenser of claim 1, the first dispenser, as a result of the first dispenser being located outside of the filling area, being configured to prevent dispensing the first medication.

7. The medical dispenser of claim 1, the first dispenser, as a result of the first pathway being located outside the filling area, being configured to prevent dispensing the first medication.

8. The medical dispenser of claim 1, the contamination area having a negative air pressure relative to the cleaning area.

9. A medical dispensing system comprising:

a filling area where a plurality of medications are dispensed into containers;

a circular pathway component comprising a plurality of pathways that include a first pathway, the first pathway being restricted to only dispense a first medication of the plurality of medications;

a dispensing component comprising a plurality of dispensers that include a first dispenser that contains the first medication, the dispensing component being rotatable to selectively position the first dispenser in the filling area, the first dispenser dispensing the first medication as a result of both the first dispenser and the first pathway being located in the filling area;

a containment structure enclosing a contamination area, the contamination area including the filling area and a portion of each of the pathway component and the dispensing component; and a cleaning area external to and hermetically sealed from the contamination area.

10. The medical dispenser of claim 9, the pathway component comprising a pathway holding position outside the filling area.

11. The medical dispenser of claim 10, the dispensing component comprising a dispenser holding position outside the filling area.

12. The medical dispenser of claim 9, the first dispenser, as a result of the first dispenser being located outside of the filling area, being configured to prevent dispensing the first medication.

13. The medical dispenser of claim 12, the first dispenser, as a result of the first pathway being located outside the filling area, being configured to prevent dispensing the first medication.

14. The medical dispenser of claim 9, the contamination area having a negative air pressure relative to the cleaning area.

15. A medical dispensing system comprising:

a filling area where medication is dispensed into containers;

a circular pathway component comprising a plurality of pathways that include a first pathway, the first pathway being restricted to only dispense a first medication of the plurality of medications;

a circular dispensing component comprising a plurality of dispensers that include a first dispenser containing the first medication, the dispensing component being rotatable to selectively position the first dispenser in the filling area, the first dispenser dispensing the first medication as a result of both the first dispenser and the first pathway being located in the filling area, the first dispenser being configured to prevent dispensing medication as a result of the first dispenser being located outside of the filling area;

a containment structure;

a contamination area interior to the containment structure, the contamination area including the filling area; and a cleaning area, the cleaning area being hermetically sealed from the contamination area.

16. The medical dispenser of claim 15, the plurality of dispensers being rotatable into and out of the contamination area as the dispensing component rotates, the plurality of pathways being rotatable into and out of the contamination area as the pathway component rotates.

17. The medical dispenser of claim 16, the contamination area having a negative air pressure relative to the cleaning area.

* * * * *